US008445060B2

(12) United States Patent
Nasatti et al.

(10) Patent No.: US 8,445,060 B2
(45) Date of Patent: May 21, 2013

(54) PROCESS AND APPARATUS FOR MANUFACTURING DECORATIVE PAPERS AND/OR PANELS FOR FLOORING OR SURFACING OF FURNITURE, WALLS, ETC

(75) Inventors: Maurizio Nasatti, Casale Monferrato (IT); Pietro Cassaghi, Rivolta d'Dadda (IT)

(73) Assignee: Surface Technologies GmbH & Co. KG, Baruth (DE)

( * ) Notice: Subject to any disclaimer, the term of this patent is extended or adjusted under 35 U.S.C. 154(b) by 240 days.

(21) Appl. No.: 12/765,028

(22) Filed: Apr. 22, 2010

(65) Prior Publication Data

US 2011/0059238 A1 Mar. 10, 2011

(30) Foreign Application Priority Data

Apr. 22, 2009 (IT) ..... MI2009A0680

(51) Int. Cl.
*B05D 1/12* (2006.01)

(52) U.S. Cl.
USPC ..... 427/202; 427/195; 427/370

(58) Field of Classification Search
USPC ..... 427/195, 202, 370
See application file for complete search history.

(56) References Cited

U.S. PATENT DOCUMENTS

| | | | | |
|---|---|---|---|---|
| 6,268,022 | B1 * | 7/2001 | Schlegel et al. | 427/471 |
| 6,406,757 | B1 * | 6/2002 | Blatter et al. | 427/517 |
| 2006/0014858 | A1 * | 1/2006 | Takano | 523/204 |

FOREIGN PATENT DOCUMENTS

| | | |
|---|---|---|
| EP | 0329154 | 8/1989 |
| EP | 1317968 | 6/1993 |
| EP | 1216759 | 6/2002 |
| GB | 658530 | 10/1951 |
| WO | 95/06568 | 3/1995 |

* cited by examiner

*Primary Examiner* — Frederick Parker
(74) *Attorney, Agent, or Firm* — Lucas & Mercanti, LLP

(57) ABSTRACT

A process for manufacturing decorative papers and/or panels for flooring or surfacing of furniture, wall, finish foils, filter papers or kraft papers for low and high pressure use etc., in which a substantially dry solid composition is prepared in powder form, having a polymer component containing aminopiasts (amino resins) and/or phenoplasts (phenolic resins) and/or mixtures in powder form, used as such and/or mixed with additives; the composition is then applied dry on a support in powder form and is heated after being deposited onto the support to melt the composition and form a coating polymer layer onto the support; the composition may instead be heated first to be molten before and then applied in a fluid form onto the support.

20 Claims, 2 Drawing Sheets

PROCESS AND APPARATUS FOR MANUFACTURING DECORATIVE PAPERS AND/OR PANELS FOR FLOORING OR SURFACING OF FURNITURE, WALLS, ETC

This application claims the priority of IT MI2009A000680 filed Apr. 22, 2009, which is incorporated by reference herein.

BACKGROUND OF THE INVENTION

1. Field of the Invention

The present invention relates to a process and apparatus for manufacturing decorative papers and/or panels for flooring or surfacing of furniture, walls, finish foils, filter papers, kraft papers etc., with powder aminoplasts and/or phenoplasts and/or mixtures as such and/or mixed with additives.

In particular, the invention relates to the manufacture of decorative papers, finish foils, kraft papers for high and low pressure, panels comprising these products, as well as panels made of plaster or other materials for walls or false ceilings and filter papers.

2. Description of Related Art

As is known, decorative papers for manufacturing panels for flooring or surfacing of furniture, walls, etc. are commonly obtained from printed and/or coloured papers, which are impregnated in a liquid solution of polymeric resins (typically melamine resins) or mixtures of resins and other compounds; after being impregnated and dried, the papers are then normally coated with mixtures of polymeric resin containing granular substances such as corundum and/or glass microspheres, they are dried again, possibly further coated with other protective and/or finishing compositions and dried again. The papers prepared thereby are therefore mainly used cut in sheets and pressed onto chipboard wooden or MDF panels or coupled with phenolic paper to obtain panels for the furniture sector, or planks for the flooring sector, or panels for the wall surfacing sector, etc. For the purpose of this description the terms "polymerization" and "polymer" are to include also "polycondensation" and "polycondensate", respectively.

The current production system employs long lines mainly formed by an unwinder, an impregnation bath, a drying oven, a first spreader, an oven, a second spreader, another oven, possibly a third spreader and a corresponding oven, a cooling unit, a winder, and/or a cutter and a paper stacking unit.

These lines are therefore very long and expensive as far as energy consumption is concerned, they produce large amounts of starting and finishing scraps and display difficulties in stopping production in progress.

A more recent technology for manufacturing panels for flooring or surfacing of furniture, walls, floors etc., the so-called direct printing, avoids the use of decorative papers, as the desired picture is directly printed onto the ready-made panel. The panels, which are appropriately treated and prepared (in particular by means of a treatment for sealing surface porosity, and possibly to lend a uniform background colour), are coloured/decorated along the line (by means of indirect single-colour or multi-colour gravure printing systems, or by means of digital printers) and dried, thus obtaining a ready-to-use product, after a final coating of UV or IR polymers to lend protection and surface hardness.

Although certainly simpler with respect to traditional methods based on the impregnation and coating of the supports and subsequent pressing, this technology does not allow to apply components increasing surface resistance to abrasion and scratching etc. on surfaces prepared in this way, nor does it allow to obtain structured surfaces (i.e. reproducing wood veinings, surface profiles in stone, etc), without using already previously structured surfaces, on which however final colours/pictures may then only be printed by a digital printing technique that implies low production rates and a quality which is not completely satisfactory.

SUMMARY OF THE INVENTION

It is an object of the present invention to provide a process and apparatus for manufacturing decorative papers and/or panels for flooring or surfacing of furniture, walls, finish foils, etc. which does not have the drawbacks of the known art set forth herein.

The present invention therefore relates to a process and an apparatus for manufacturing decorative papers and/or panels for flooring or surfacing of furniture, walls, etc. as defined in substantial terms herein and, respectively, as far as regards their preferred aspects.

Substantially, according to the invention, the support (which may be a raw, either pre-treated or pre-impregnated paper support of the decorative paper, or a wooden fibre support, or a ready-pressed or laminated panel, or a plaster panel, etc.) is treated by using a treatment composition in a solid particulate form, substantially powder, instead of using the traditional impregnation and coating techniques with impregnating baths and water or solvent coating compositions.

In particular, the composition is a substantially dry solid composition having a polymeric component containing aminoplasts (amino resins, in particular urea resins or melamine resins) and/or phenoplasts (phenolic resins) in powder form, used as such and/or mixed with additives and derives for instance from conventional dehydrated resins. This does not exclude compositions containing some water which is chemically or strongly physically bound within the powder material. However, it is essential for the powder material to be pourable.

The at least partial melt of the composition can for example already be achieved by melting the amino resin.

More specifically, the composition contains: one or more polycondensation thermosetting resins, in particular selected from the group consisting of aminoplasts, phenoplasts and mixtures thereof; one or more suitable catalysts (also in granule or powder form) for catalyzing polymerization or cross-linking, e.g. an organic acid or one salt derivative from a strong acid plus weak base; optionally, depending on the kind of treatment to be carried out, other particulated substances such as corundum, glass or ceramic microspheres, alfa-cellulose, etc.; optionally, other additives for polymeric compositions, organic and/or inorganic charges and fillers and/or minerals; optionally, decorative materials such as reflective, glittering, metallescent, etc. materials, in form of specks, granules, fibres, etc.

According to a variant, the composition contains, as an alternative or in addition to the polymeric component in powder form, a mixture of reactants in powder form apt to react (condensate) to form at least one polymeric resin; in particular, the composition contains a mixture of reactants in powder form which are precursors of aminoplasts and/or phenoplasts, such as melamine, urea, phenol, formaldehyde. Also derivatives of these compounds are useful to obtain free flowing powders, e.g. phenolates or paraformaldehyd.

The resins and/or the powder reactants have a granulometry less than about 1000 μm and preferably ranging between about 0.1 μm and about 500 μm.

Suitable powders can be manufactured e.g. from aqueous solutions of the components by known processes such as spray drying. Suitable aqueous solutions can be prepared by methods known in the art and some of these are commercially available, e.g. solutions containing prepolymers or precondensates of phenol, urea or melamin with formaldehyde. It is possible to provide powders of the individual components separately and mix these powders before application to the support in a composition preparation unit. As far as the aqueous solutions of specific components are compatible and do not react with each other, they can be mixed beforehand and the mixture may be used for preparation of the dry powder.

According to a first preferred embodiment, the composition is applied dry directly onto the support to be treated, and here it is melted by heating; while a variant provides that the composition in solid particle form is melted and applied onto the support in a molten form, by means of a suitable applying device (for instance, but not necessarily, a flat head, a roller system, a blade system, etc.)

In the first embodiment, the application of the composition takes place by means of a powder doser that spreads the required amount of powder directly onto the support with an accurate control of the distribution. Since the powder material is at least partially melted after deposition on the support and is thus secured to the surface thereof, it is not necessary to pretreat the support surface with a liquid, e.g. a glue.

The application of the powder composition takes place by a two-stage dosing (pre-dosing and fine dosing), in case a high precision is required, or simply by a single dosing stage.

Variable amounts of powder composition are used in the various applications ranging between about 1 and about 200 $g/m^2$, depending on the end product and on its mechanical and physical-chemical features, also with special reference to the surface abrasion, brightness, scratch resistance features.

The support, on which the powder composition has been deposited, subsequently undergoes a heating step, for instance by means of IR lamps, microwave systems, by a controlled flame or any other suitable heating system (although clearly not blowing hot air directly on the support, as this would blow away the deposited powders).

Preferably, the heating is performed at temperatures ranging between about 50 and about 200° C.

The heating determines the melting of the resin and the cross-linking and/or polymerisation reactions required to form a polymeric layer, incorporating the possibly present additives, on the support.

After a possible cooling step, the support is ready for the following processing steps. In particular, the support (in particular the paper support) is ready to be pressed (at a pressure ranging between about 5 and 100 bars) together with other layers of various materials in a press to obtain panels for the sectors of furniture or surfacing, slats, planks for flooring, etc. with conventional systems and directly on the line. Pressing is preferably performed at elevated temperature, most preferably between 130 and 200° C. During this step cross-linking of the hitherto not or just partly cross-linked polymer resin may be completed.

Optionally, the support undergoes a pre-heating step before the application of the composition. This can assist adhesion of the powder to the support.

Preferably, both faces of the support are treated in the above disclosed manner, i.e. the composition is applied on both faces by means of respective passages. The treatment composition for both sides can be identical or different. If the support is sufficiently flexible, it can be turned upside down and treated on both sides in a continuous operation in a single production line. Rigid supports can be turned upside down in form of separate segments.

In the second embodiment, the treatment powder composition is previously melted and then applied onto the support by means of a suitable applying device, apt to distribute the fluid composition onto the support in a controlled manner.

The dry composition, again containing one or more polymeric resins, catalysts and optionally other additives, all in a solid form, previously prepared and/or mixed, is molten in appropriate melters (for instance heated electrically or by means of diathermal oil or other heating fluids) and applied by means of the applying device, with an optimum weight and percentage distribution both longitudinally (feeding direction of the support), and transversally (perpendicular direction with respect to the feeding direction of the support).

Even in this variant, the resins employed are the same as indicated previously.

Clearly, to treat both faces of the support two applicators may be used operating on respective faces of the supports.

According to the invention, the treated support may be a paper support that is used to obtain a decorative paper to then be pressed together with other layers in order to obtain a panel; as an alternative it may be a ready-pressed or laminated panel made of wooden fibre, plaster, etc. The composition (again of the kind disclosed previously) is applied (with similar modes to those already disclosed, and specifically in the form of dry powder, or after being melted in a fluid form by means of a suitable applying device) onto a support which is a ready-made panel and optionally has a printed decoration.

With respect to the known technologies, the present invention has the following main advantages:

dramatic reduction of the energy installed and used for drying the water used in the traditional impregnating and coating treatments;

practically no polluted exhaust air, ease of stocking and absence of preparation of baths to obtain resins suitable for use;

simplicity in preparation and use of resins and additives; only mixing of the powders is required to obtain the features of the product to be obtained;

possibility to stop and start the line again with significantly less or even no scrap or raw material loss at all, as the paper support is never wet and remains firmly drawn-in through the machine;

ease of drawing-in the line, as the support is always dry;

optimum longitudinal and transversal weight distribution, as it is obtained by a preparation outside the line of the component powder mixtures, which are dosed and distributed onto the support by means of powder dosers (optionally with a double pre-dosing and dosing system) or suitable applicators, both systems allowing an accurate regulation;

the problems related to difficulties in maintaining perfectly mixed and well distributed the various compounds having different specific weight (for instance sedimentation in mixtures of liquid resin, corundum, glass microspheres, etc.) are totally avoided, as they are used dry in powder;

the surface wear of the spreading rollers which undergo a continuous friction with particularly hard particles, such as corundum, ceramic microspheres, etc., is totally avoided;

the powder feeding system is a powder total use system, therefore no recirculation system is required, as is currently used for spreaders;

problems related to aging of the prepared and wet resin, and to its catalysis are avoided, as only non-aging powders and dry mixtures are used;

the line may even be stopped for a long time, without needing to clean the same;

the problem of whitening the surface in the press is avoided, as the percentage of residual humidity in the starting powders may be perfectly controlled upstream (milky or foggy effect);

if applied to a production line of the direct printing type, the process of the invention allows to obtain high quality products very similar to those that may be obtained with traditional techniques of paper impregnation and panel pressing, also having structured surfaces, the impregnated paper can be used immediately for hot pressing of laminates, therefore the impregnation apparatus can be integrated into the production line for laminate.

BRIEF DESCRIPTION OF THE DRAWINGS

The invention is further disclosed in the following non-limitative embodiments, with reference to the accompanying drawings, in which.

DETAILED DESCRIPTION OF THE INVENTION

Figure 1:
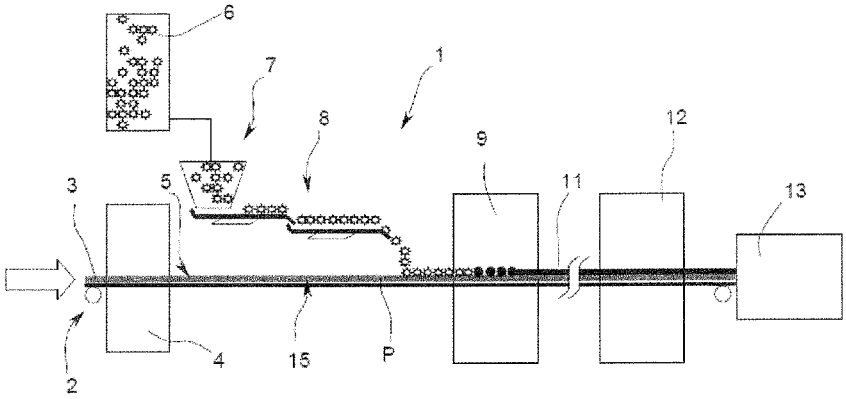
FIG. 1 is a diagrammatic view of an apparatus operating in use in a first embodiment of the process for manufacturing decorative papers and/or panels for flooring or surfacing of furniture, walls, etc. according to the invention.

With reference to FIG. 1, an apparatus 1 for manufacturing decorative papers and/or panels for flooring or surfacing of furniture, walls, etc. substantially comprises:

a handling line 2 to feed a support 3 along a pre-determined path P; support 3 is an optionally pre-treated or pre-impregnated raw paper support optionally printed or otherwise decorated/coloured, or any other kind of support, for instance a panel made of different materials (wooden fibres or chips, plaster etc.), in turn optionally already printed in a printing unit (known and not shown); although in FIG. 1 support 3 is shown as a strip material, obviously it may also be formed by a series of elements such as panels, sheets, etc.;

an (optional) pre-heating unit 4 for support 3, in which support 3 transits and in which support 3 and specifically at least one first face 5 thereof (for instance, the upper face) are heated at a predetermined temperature;

a preparation unit 6 for the powder compositions, in which a substantially dry or even anhydrous powder treatment composition, as previously disclosed, is prepared;

an application group 7, comprising in particular a powder dosing device 8, connected to preparation unit 6 to distribute the powder composition onto support 3; dosing device 8 is for instance (but not necessarily) of the vibrating sieve type and allows the granules of the composition to fall by gravity onto face 5 of support 3; dosing device 8 may be of other kind, but in general is in any case capable of finely dosing and uniformly distributing the powder composition onto support 3 both longitudinally (feeding direction of the support) and transversally (perpendicular direction with respect to the feeding direction of the support);

a heating unit 9 for fixing the powders, comprising for instance IR lamps and/or a microwave oven or a tunnel oven, positioned downstream of dosing device 8 along path P and in which the composition is heated so as to melt the polymeric component therein (resin/s) and trigger the cross-linking/polymerisation reaction thereof and form a polymeric coating layer 11 on face 5 of support 3;

possibly, a cooling unit 12 to harden the polymeric component of the treatment composition.

Optionally, apparatus 1 comprises multiple application groups 7 (having respective powder dosing devices 8) followed by respective heating units 9 (and optionally by respective cooling units 12), in order to sequentially apply respective polymeric compositions (preferably again of the kind disclosed above) having different components, formulations or properties.

For instance, apparatus 1 also sequentially comprises along path P downstream of first heating units 9:

a second powder application group to dose and distribute, over the composition applied in the previous powder application group, a second composition (similar or different with respect to the previous one, but in general also formed by one or more melamine and/or phenolic resins, by suitable catalysts and additives, for instance corundum, glass microspheres, etc.), so as to apply a further polymeric coating layer onto the support to improve some surface features of the product;

a second heating unit, for instance comprising IR lamps and/or a tunnel or microwave oven;

a third powder application group to apply a third protective polymeric layer, formed by resin and protective additives (such as glass microspheres, alpha-cellulose, etc.);

a third heating unit, for instance comprising IR lamps and/or a tunnel or microwave oven;

A finishing or decoration station 13 may be positioned at the end of handling line 2 to apply a picture, impression or finishing onto the treated support, for instance by means of release paper, in addition or as an alternative to a collection station for treated support 3, for instance a winder, or a sheet cutting and stacking unit, etc.

The operation of apparatus 1 for carrying out the process of the invention is as follows.

Support 3, which—as already shown—may be a paper support or a panel made of another material, is fed along handling line 2 and, after possibly passing through (optional) pre-heating unit 4, passes under dosing device 8 of application group 7; the treatment composition, which has previously been prepared in preparation unit 6, is distributed by means of dosing device 8 on face 5 of support 3.

Support 3 therefore passes through heating unit 9 where the polymeric component (resin/s) at least partly melts and cross-links/polymerises embedding the particles of the other substances in the composition, and then into cooling unit 12.

If the composition includes precursor reactants of polymeric resins instead of one or more already polycondensed resins of this type, the heating step (performed at suitable temperature and pH) induces the in situ polymerisation of the reactants and the formation of the resin or corresponding polymeric resins directly on the support.

One opposite face 15 of support 3 is then treated in a similar manner by means of further units and groups of the type disclosed above, or by carrying support 3, turned upside down, through the same units and groups used to treat face 5.

Figure 2:
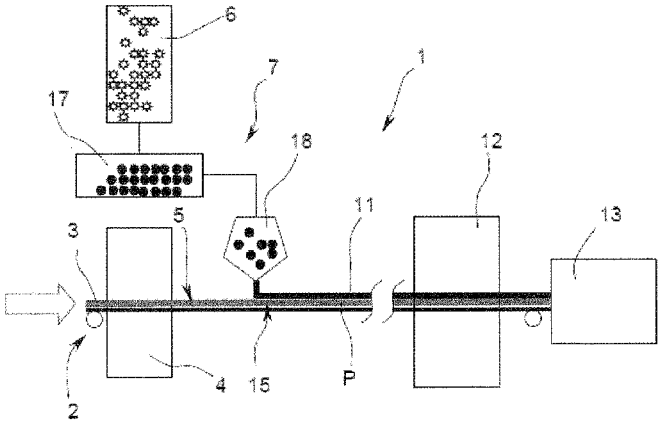
FIG. 2 shows a variant of the apparatus according to claim 1, operating in use in a second embodiment of the process according to the invention.

In the variant of FIG. 2, in which similar or identical details to those already disclosed are indicated by the same numerals, system 1 further comprises handling line 2 to feed support 3 along predetermined path P, (optional) pre-heating unit 4, powder composition preparation unit 6, and an application group 7.

In this case, however, application group 7 comprises a melter 17, connected to preparation unit 6 and in which the powder composition prepared in preparation unit 6 is heated so that its polymeric component is melted and taken to a fluid state; and an applying device 18, apt to apply and distribute the fluid composition, possibly embedding solid particles, on face 5 of support 3. Applying device is for instance, but not necessarily a flat head, a roller system, a blade system, etc.

Heating unit 9 is therefore not required for fixing the powders, as the powder polymeric component is melted upstream of applying device 18 and therefore before the application of the composition onto support 3.

Apparatus 1, instead, also comprises, possibly, cooling unit 12.

Also in this variant, apparatus 1 may comprise multiple applying groups 7, to sequentially apply respective polymeric compositions (preferably again of the previously disclosed type) having different components, formulations or properties, as disclosed previously.

To treat both faces 5, 15 of support 3 two applying devices 18 may be used arranged on opposite sides of support 3 ad operating on respective faces 5, 15 of support 3.

The process of the invention, carried out with apparatus 1 of FIG. 2, is identical to that disclosed with reference to FIG. 1, except that, now, the powder polymeric component is melted before the application of the composition onto support 3; the composition is therefore applied in a fluid form onto the support, being formed by the molten polymer component that embeds the possible other particle substances present.

Figure 3:
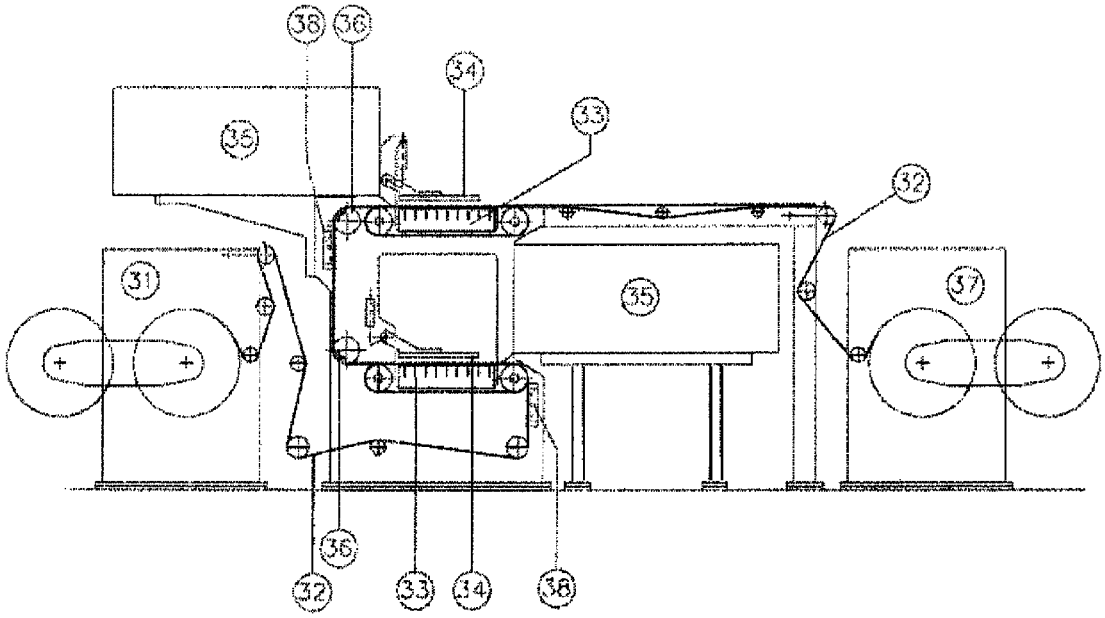
FIG. 3 shows an example of an apparatus according to the invention suited for impregnating a paper web on both sides in one run.

With reference to FIG. 3 an apparatus according to the invention is shown which is modified so that it is capable to coat and impregnate both sides of a paper web in a single run. The web 32 is fed into the apparatus from an unwinder 31 and after a number of guide rollers it reaches a pre-heating device 38 to pre-heat the support in order to assist adhesion of the powder by creating a sticky, paste-like state, a first powder scattering unit 35, where a powder material according to the invention is spread on the first side. The web with the powder on the first side passes by, preferably under a first IR heater 34 while being held by a vacuum belt 33 to avoid warping of the paper under the influence of heat and to permit the starting of the penetration of the at least partially molten powder into the web. The powdery material is melted by the IR heater 34 radiation and this way secured to the paper web. In order to also coat the second side of the web, the web must be turned. This is accomplished by passing it over (in this case two) turning stations 36 having air cushions which do not contact the treated surface of the support. This is done to avoid damage of the superficial layer, which may still be soft at this point. Then the second pre-heating device 38 pre-heats the support and a second powder scattering unit 35 coats the second side of the paper web with powder material. Again the web passes by an IR heater 34 and is held there by vacuum belt 33. Finally the web is rewound on rewinder 37 and optionally (not shown in the FIG. 3) cut in sheets and stacked.

An apparatus of this type offers a number of opportunities. For example the paper can be used for decorative coatings on wooden materials for making panels for furniture or flooring. The two layers may be different, e.g. one may be an decorative and abrasion resistant layer for the upper side of a flooring panel, the other may be just a material for gluing the paper to the support. A similar apparatus can be used for preparing an impregnated backing layer for the flooring panel or, alternatively, a second decorative layer for furniture application.

As can be seen, an apparatus of this kind can e.g. be easily added to a continuously working manufacturing line for making fiberboard. This way it is possible to make a decorated panel in one run starting from fiber pulp.

Another example of application of the apparatus is the production of the filter papers or kraft papers for low and high pressure use.

It should be understood that further modifications and variants which do not depart from the scope of the appended claims may be made to the system disclosed and shown herein.

LIST OF REFERENCE NUMERALS

1 dry impregnation system
2 handling line
3 support to be treated
4 pre-heating unit
5 surface to be treated (first)
6 preparation unit
7 application group
8 dosing device
9 heating unit
11 fused/melted layer
12 cooling unit
13 finishing station
15 opposite surface
17 melter
18 applying device
31 unwinder
32 paper web
33 vacuum belt
34 IR heater
35 powder scattering unit
36 turning station (air cushion)
37 Rewinder
38 pre-heating device
P path of support

The invention claimed is:

1. A process for manufacturing a panel for flooring, surfacing of furniture or walls, comprising the steps of a) preparing a substantially dry, solid powder treatment composition, the treatment composition comprising a polymeric resin or a mixture of reactants that are adapted to react and form the polymeric resin, the polymeric resin being an amino resin or a phenolic resin or a mixture of amino resin and phenolic resin;

b) applying the substantially dry, solid powder treatment composition to a support;

c) heating the substantially dry, solid powder treatment composition on the support to form a polymeric coating layer on the support; and d) pressing and heating the support having the polymeric coating layer formed thereon together with other layers at a temperature between 130 and 200° C. and a pressure between 5 and 100 bars to form the panel.

2. The process of claim 1, wherein the polymeric resin is selected from the group consisting of urea resins, melamine resins, phenolic resins, and mixtures thereof.

3. The process of claim 1, wherein the reactants are selected from the group consisting of melamine, urea, phenol, formaldehyde, derivatives thereof, and mixtures thereof.

4. The process of claim 1, wherein the treatment composition further contains one or more catalysts in granule or powder form.

5. The process of claim 1, wherein the treatment composition comprises one or more solid substances selected from the group consisting of corundum, glass microspheres, ceramic microspheres, alfa-cellulose, decorative materials, and metallescent materials.

6. The process of claim 1, wherein the substantially dry, solid powder treatment composition has a granulometry less than about 1000 μm.

7. The process of claim 1, further comprises a step of pre-heating the support before applying the treatment composition.

8. The process of claim 1, wherein the support has opposite faces, and the treatment composition is applied, and heated on both opposite faces of the support.

9. The process of claim 6, wherein the granulometry is 0.1 μm to 500 μm.

10. The process of claim 1, further comprises a step of cooling the support having the polymeric coating layer formed thereon before pressing and heating the support together with other layers.

11. A process for manufacturing a panel for flooring, surfacing of furniture or walls comprising the steps of:

a) preparing a substantially dry, solid powder treatment composition, the treatment composition being a polymeric resin or a mixture of reactants that are adapted to react and form the polymeric resin, the polymeric resin being an amino resin or a phenolic resin or a mixture of amino resin and phenolic resin;

b) heating the substantially dry, solid, powder treatment composition to form a fluid treatment composition;

c) applying the fluid treatment composition to the support to form a polymeric coating layer on the support; and d) pressing and heating the support having the polymeric coating layer formed thereon together with other layers at a temperature between 130 and 200° C. and a pressure between 5 and 100 bars to form the panel.

12. The process of claim 11, wherein the polymeric resin is selected from the group consisting of urea resins, melamine resins, phenolic resins, and mixtures thereof.

13. The process of claim 11, wherein the reactants are selected from the group consisting of melamine, urea, phenol, formaldehyde, derivatives thereof, and mixtures thereof.

14. The process of claim 11, wherein the treatment composition further contains one or more catalysts in granule or powder form.

15. The process of claim 11, wherein the treatment composition comprises one or more solid substances selected from the group consisting of corundum, glass microspheres, ceramic microspheres, alfa-cellulose, decorative materials, and metallescent materials.

16. The process of claim 11, wherein the substantially dry, solid powder treatment composition has a granulometry less than about 1000 μm.

17. The process of claim 11, further comprises a step of pre-heating the support before applying the treatment composition.

18. The process of claim 11, wherein the support has opposite faces, and the treatment composition is applied and heated on both opposite faces of the support.

19. The process of claim 11, wherein the granulometry is 0.1 μm to 500 μm.

20. The process of claim 11, further comprises a step of cooling the support having the polymeric coating layer formed thereon before pressing and heating the support together with other layers.

* * * * *

UNITED STATES PATENT AND TRADEMARK OFFICE

CERTIFICATE OF CORRECTION

PATENT NO. : 8,445,060 B2
APPLICATION NO. : 12/765028
DATED : May 21, 2013
INVENTOR(S) : Maurizio Nasalti et al.

It is certified that error appears in the above-identified patent and that said Letters Patent is hereby corrected as shown below:

please delete the item [73], on title page of patent

"Surface Technologies GmbH & Co. KG, Baruth (DE)"

Signed and Sealed this
Thirty-first Day of December, 2013

Margaret A. Focarino

Margaret A. Focarino
*Commissioner for Patents of the United States Patent and Trademark Office*

UNITED STATES PATENT AND TRADEMARK OFFICE

CERTIFICATE OF CORRECTION

PATENT NO. : 8,445,060 B2
APPLICATION NO. : 12/765028
DATED : May 21, 2013
INVENTOR(S) : Maurizio Nasatti et al.

It is certified that error appears in the above-identified patent and that said Letters Patent is hereby corrected as shown below:

Title page, "item (75)" should read -- item (76) --.

Title page, please delete the item (73),

"Surface Technologies GmbH & Co. KG, Baruth (DE)".

This certificate supersedes the Certificate of Correction issued December 31, 2013.

Signed and Sealed this
Fifteenth Day of April, 2014

Michelle K. Lee

Michelle K. Lee
*Deputy Director of the United States Patent and Trademark Office*